US011199348B1

(12) United States Patent
Wang

(10) Patent No.: US 11,199,348 B1
(45) Date of Patent: Dec. 14, 2021

(54) REFRIGERANT CHARGING HOSE ASSEMBLY

(71) Applicant: Bokang Wang, Newark, DE (US)

(72) Inventor: Bokang Wang, Newark, DE (US)

(73) Assignee: Weitron, Inc., Newark, DE (US)

( * ) Notice: Subject to any disclaimer, the term of this patent is extended or adjusted under 35 U.S.C. 154(b) by 0 days.

(21) Appl. No.: 16/258,813

(22) Filed: Jan. 28, 2019

Related U.S. Application Data

(60) Provisional application No. 62/624,522, filed on Jan. 31, 2018.

(51) Int. Cl.
*F25B 45/00* (2006.01)
*B25B 27/24* (2006.01)

(52) U.S. Cl.
CPC ..... *F25B 45/00* (2013.01); *B25B 27/24* (2013.01); *F25B 2345/001* (2013.01); *F25B 2345/006* (2013.01)

(58) Field of Classification Search
CPC ..... F25B 45/00; F25B 2345/001; F25B 2345/006; F25B 2400/121; B60H 1/00585; B25B 27/24
See application file for complete search history.

(56) References Cited

U.S. PATENT DOCUMENTS 3,712,113 A 1/1973 Roscoe
3,813,893 A 6/1974 Gemender et al.
3,916,641 A 11/1975 Mullins
3,935,713 A 2/1976 Olson
3,976,110 A 8/1976 White
4,281,775 A * 8/1981 Turner ..... B67B 7/26 137/318
4,319,459 A 3/1982 Hannett et al.
4,884,410 A 12/1989 Bell et al.
4,941,600 A 7/1990 Berriochoa et al.
5,090,212 A 2/1992 Keltner et al.
5,117,641 A 6/1992 Keltner
5,168,720 A 12/1992 Keltner
5,218,831 A 6/1993 Keltner
5,220,810 A 6/1993 Keltner
5,231,843 A 8/1993 Keltner
5,247,803 A 9/1993 Adams et al.
5,247,812 A 9/1993 Keltner
5,295,367 A 3/1994 Keltner
5,333,467 A 8/1994 Pearl, II et al.
6,089,032 A 7/2000 Trachtenberg
(Continued)

OTHER PUBLICATIONS

One page printout showing "Measuring & Dispensing" charging hoses of Interdynamics from a 2005 Auto Air Conditioning Product Catalog.

*Primary Examiner* — Joseph F Trpisovsky
(74) *Attorney, Agent, or Firm* — Tuggle Duggins P.A.; Blake P. Hurt

(57) ABSTRACT

A refrigerant charging hose assembly including a can tap connectable to the self-sealing valve of a R-1234yf refrigerant can with a one-half inch ACME left-handed thread on a self-sealing cap, a length of refrigerant charging hose, and a coupler fitting on the other end connectable to an R-1234yf automotive air conditioning system. An alternate embodiment of the refrigerant charging assembly can serve as a refrigerant charging and pressure testing hose assembly and includes a pressure gauge installed in the hose between the can tap and the coupler fitting.

8 Claims, 7 Drawing Sheets

(56) References Cited

U.S. PATENT DOCUMENTS

| | | | | |
|---|---|---|---|---|
| 6,360,554 | B1 | 3/2002 | Trachtenberg | |
| 6,385,986 | B1 | 5/2002 | Ferris et al. | |
| 6,446,453 | B1 | 9/2002 | Trachtenberg | |
| 6,467,283 | B1 | 10/2002 | Trachtenberg | |
| 6,609,385 | B1 | 8/2003 | Ferris et al. | |
| 6,698,466 | B1 | 3/2004 | Cowan et al. | |
| 6,722,141 | B2 | 4/2004 | Ferris et al. | |
| 6,796,340 | B1 | 9/2004 | Ferris et al. | |
| 6,978,636 | B2 | 12/2005 | Motush et al. | |
| 7,077,171 | B2 | 7/2006 | Carrubba | |
| 7,107,781 | B2 | 9/2006 | Quest et al. | |
| 7,260,943 | B2 | 8/2007 | Carrubba et al. | |
| 7,275,383 | B2 | 10/2007 | Motush et al. | |
| 8,322,151 | B1 * | 12/2012 | Garofalo | G01K 13/00 62/127 |
| 8,875,524 | B1 | 11/2014 | Parnell | |
| 9,243,829 | B1 | 1/2016 | Parnell | |
| 9,915,357 | B1 * | 3/2018 | Ehlert | F16K 5/0605 |
| 2004/0060605 | A1 * | 4/2004 | Jhurani | F16K 1/305 137/614.2 |
| 2006/0086123 | A1 * | 4/2006 | Quest | B60H 1/00585 62/292 |
| 2013/0118187 | A1 * | 5/2013 | Carrubba | F25B 45/00 62/77 |
| 2015/0203278 | A1 * | 7/2015 | Koban | F17C 13/04 222/544 |
| 2015/0260438 | A1 * | 9/2015 | Ronga | F25B 45/00 62/292 |
| 2019/0186796 | A1 * | 6/2019 | Govekar | F25B 45/00 |

* cited by examiner

REFRIGERANT CHARGING HOSE ASSEMBLY

This non-provisional patent application claims all benefits under 35 U.S.C. § 119(e) of U.S. provisional patent application Ser. No. 62/624,522 filed 31 Jan. 2018, entitled "Refrigerant Charging Hose Assembly", in the United States Patent and Trademark Office, which is incorporated by reference in its entirety herein.

FIELD OF THE INVENTION

This invention pertains to a refrigeration system tool, and in particular, a refrigerant charging hose assembly including a can tap connectable to the self-sealing valve of a R-1234yf refrigerant can with a one-half inch ACME left-handed thread on a self-sealing cap, a length of refrigerant charging hose, and a coupler fitting on the other end connectable to an R-1234yf automotive air conditioning system.

DESCRIPTION OF THE PRIOR ART AND OBJECTIVES OF THE INVENTION

It is common practice to introduce fluid into a refrigeration system, such as an automotive air conditioning system, from a container in which the fluid is commercially packaged. For example, relatively small quantities of refrigerants such as R-134a, a hydrofluorocarbon (HFC), are typically packaged in cylindrical cans. A special purpose tool may be utilized to dispense the refrigerant and/or other fluid (e.g., lubricant, leak detector, seal rejuvenator, etc.) into the refrigeration system. In one conventionally manufactured version thereof, the tool includes a can tap, a length of refrigerant charging hose, and a coupler fitting connectable to an automobile air conditioning system.

Recently, due to environmental global warming concerns of hydrofluorocarbons (HFCs), regulatory bodies have approved the use of R-1234yf refrigerant, a hydrofluoroolefin (HFO), for many refrigerant applications. These regulatory agencies have also required that a specific valve thread (a one-half inch ACME left-handed thread) be used on any commercial container that holds R-1234yf. Therefore, the prior art tools that are configured to securely engage R-134a cans will not accommodate the self-sealing valve included with the R-1234yf refrigerant cans, as they (1) require a left-handed, compared to a right-handed, thread pattern which is a different thread pattern; and (2) have a self-sealing valve on the can compared to regular caps which only have a thin metal seal that is destroyed in liberating the refrigerant.

Further, the so-called "low side" refrigerant circuit service fitting in an R-1234yf automotive air conditioning system also requires a specific coupler designed for R-1234yf automotive air conditioning systems. Therefore, the couplers in the prior art charging hose assembly tools that are configured to connect R-134a automotive air conditioning system will not accommodate the R-1234yf automotive air conditioning system.

Another disadvantage of various charging hose assemblies currently on the market is that the can tap on the first end of the hose does not have a backflow preventer. While charging the automotive A/C system, the can should be connected to the low pressure service port of the A/C system. However, if a technician accidentally connects it to the high pressure service port (an occurrence that happens with some regularity), using a charging hose assembly without a backflow preventer will be dangerous as the refrigerant from the system may flow into the can and cause it to explode. This is especially dangerous when technicians are working with R-1234yf since it is a flammable refrigerant. Therefore an integrated backflow preventer on the can tap end is needed.

Therefore, it is an objective of the present invention to provide a tool, in a preferred embodiment thereof, more particularly relating to a refrigerant charging hose assembly, that can safely dispense a self-sealing valve, R-1234yf refrigerant can with a one-half inch ACME left-handed thread pattern and can safely add refrigerant to an R-1234yf automotive air conditioning refrigerant circuit from an R-1234yf self-sealing valve refrigerant can.

It is another objective of the present invention to provide a refrigerant charging hose assembly that can serve as a refrigerant charging/pressure testing hose assembly including a can tap on the first end connectable to the self-sealing valve of a R-1234yf refrigerant can with a one-half inch ACME left-handed thread on a self-sealing cap, a length of refrigerant charging hose, a coupler fitting on the other end connectable to an R-1234yf automotive air conditioning system, and a pressure gauge installed in line with the hose between the can tap and the coupler fitting.

Various other objectives and advantages of the present invention will become apparent to those skilled in the art as a more detailed description is set forth below.

SUMMARY OF THE INVENTION

The aforesaid and other objectives are realized by providing a refrigerant charging hose assembly which includes a can tap on the first end of a hose connectable to the self-sealing valve of a R-1234yf refrigerant can with a one-half inch ACME left-handed thread on a self-sealing cap, a length of refrigerant charging hose and a coupler fitting on the other end connectable to the low side refrigerant circuit service fitting of an R-1234yf automotive air conditioning system. The can tap on the hose first end has a tap body which has an inlet and an outlet, an internal pin, a gasket, and a backflow preventer. The inlet of the tap body has the one-half inch ACME left-handed thread, permitting secure engagement with the R-1234yf can which is required by law to be sold with this thread pattern. The backflow preventer is positioned at the connection between the outlet of the can tap and the throat on the tap body. The internal pin has a flow portion in fluidic communication with the inlet and the outlet of the tap body. The internal pin has a blunt depressor capable of engaging the self-sealing valve on the container. The flow portion of the pin allows fluid to flow between the tap body and the internal pin. The can tap has a gasket comprising a material preventing the refrigerant from leaking while charging.

An alternative embodiment of the refrigerant charging hose assembly described above may further be used as a refrigerant charging/pressure testing hose assembly. The refrigerant charging/pressure testing hose assembly includes a can tap on the first end of a hose connectable to the self-sealing valve of a R-1234yf refrigerant can with a one-half inch ACME left-handed thread on a self-sealing cap, a length of refrigerant charging hose, a coupler fitting on the other end connectable to the low side refrigerant circuit service fitting of an R-1234yf automotive air conditioning system, and a pressure gauge installed on or in the hose between the can tap and the coupler fitting. This pressure gauge receives fluid pressure information and displays the same to a technician, reducing the likelihood of over-pressurization to the system and causing a failure.

DETAILED DESCRIPTION OF THE PREFERRED EMBODIMENT AND OPERATION OF THE INVENTION

Figure 1:
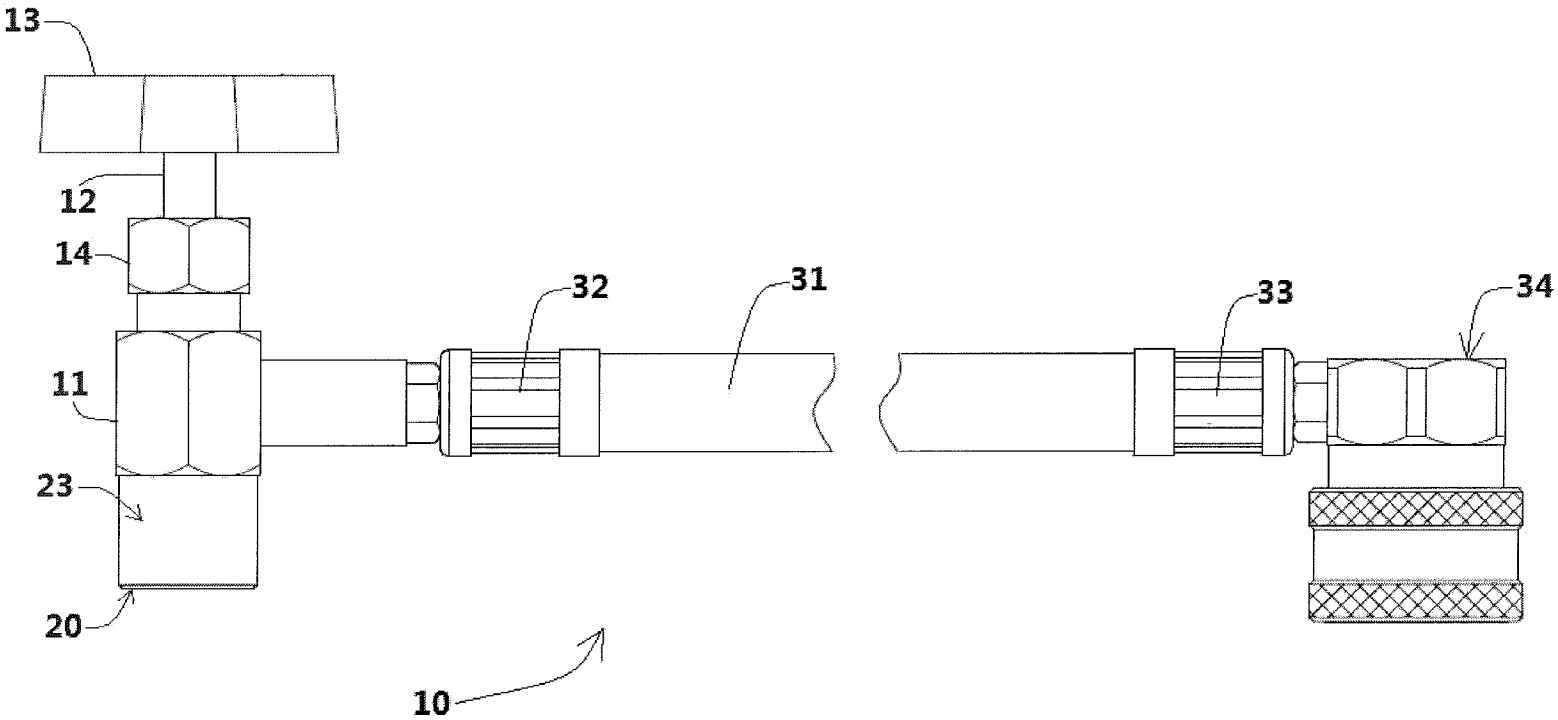
FIG. 1 shows a side view of a R-1234yf charging hose assembly of indeterminate length.

For a better understanding of the invention and its operation, turning now to the drawings, Figures (Fig. or FIGS. 1-5 illustrate the preferred embodiment of refrigerant charging hose assembly 10 that embodies principles of the present invention and is configured (i.e. sized and shaped) to flow pressurized refrigerant R-1234yf disposed within a pressurized refrigerant can (not shown) equipped with the one-half inch ACME left-handed thread self-sealing valve 43 (FIG. 6), into an R-1234yf automotive air conditioning system via its low side refrigerant circuit service fitting. The refrigerant charging hose assembly 10 includes a length of R-1234yf charging hose 31 having a tubular metal connector fittings 32 and 33 fixedly secured to its opposing longitudinal ends. Fitting 32 is preferably permanently affixed to the R-1234yf self-sealing valve can tap 20 and fitting 33 is preferably permanently attached to the coupler fitting 34 designed for the R-1234yf automotive air conditioning system. The length of charging hose 31 is represented in a broken embodiment to indicate that a specific length should not be considered a limitation on the present disclosure. In one or more alternate embodiment(s), can tap 20, preferably defined as the R-1234yf self-sealing valve can tap 20, is removable from the charging hose 31, preferably defined as a R-1234yf charging hose, by the tubular metal connector fitting 32. In one or more alternate embodiments(s), coupler fitting 34 as designed for the R-1234yf air conditioning system (not shown) is removable from the R-1234yf charging hose 32 by the tubular metal connector fitting 33. Embodiments of said connector fittings 32, 33 may have releasably threaded members, releasably mechanical members, or releasably adhesive members to effectuate the removal of hose 31 from can tap 20 and/or fitting 34.

Figure 2:
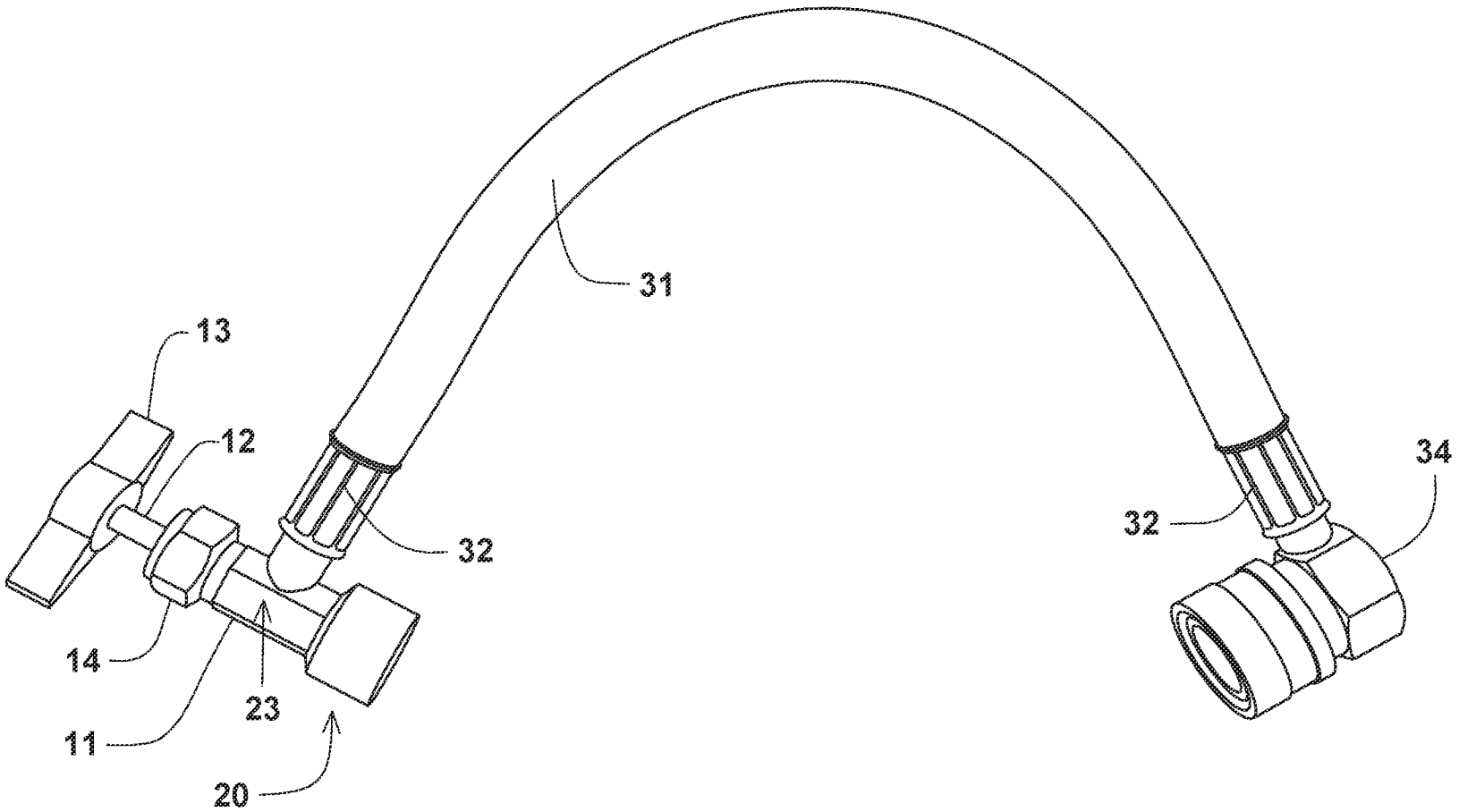
FIG. 2 pictures an elevated side view of the R-1234yf charging hose assembly of FIG. 1.
Figure 3:
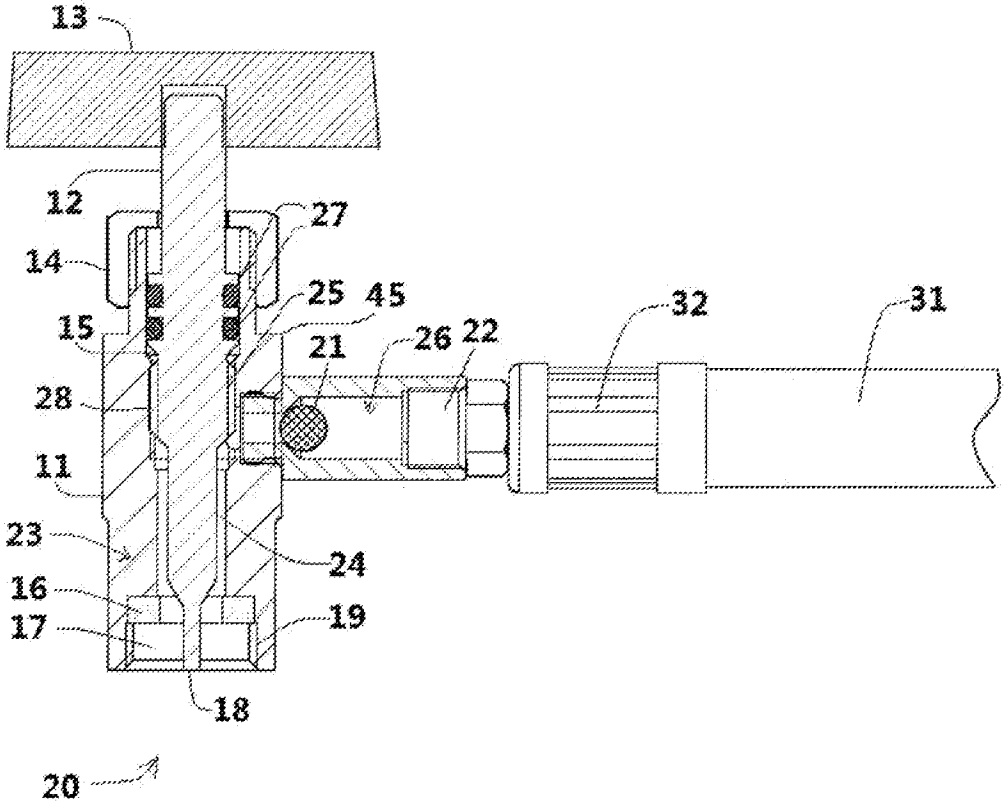
FIG. 3 depicts a longitudinal cross-section side view of a male portion of the R-1234yf charging hose assembly of FIG. 1 as seen along lines 29-29 in FIG. 5.

As best shown in FIGS. 1-3, the one-half inch ACME left-handed thread can tap 20 includes tap body 11, pin 12, gasket 16, inlet 17, backflow preventer 21, and the outlet 22. Tap body 11 comprises nut 14 and main body 23 which locks pin 12 in the main body 23. Tap body 11 defines a throat 24, which is in fluidic communication with tap outlet 22 at the upper end 45 of tap body 11. The internal thread 25 on the main body 23 engages with the pin internal thread 28 permitting pin 12 to move upwards or downwards. Inlet thread 19 has the one-half inch ACME left-handed thread and it therefore can engage with the R-1234yf can which has the one-half inch ACME left-handed thread. The can tap preferably includes a gasket 16 formed from a resilient material such as rubber, preventing the refrigerant from leaking while charging. The outlet 22 is preferably attached to an end portion of the hose 31 by the tubular metal connector fitting 32.

The backflow preventer 21 is positioned in the connection 26 between the outlet 22 and the main body throat 24. The backflow preventer 21 allows the fluidic communication from the main body throat 24 to the outlet 22, but is configured to stop the fluidic communication from the outlet 22 to the main body throat 24 (i.e. in the opposite direction).

Pin 12 is attached to handle 13 that may be turned to raise or lower pin 12, which engages tap body 11 through tap body internal threads 25 and pin internal thread 28. The pin internal thread 28 on the pin engages with the internal thread 25 on the main body 23 by which the pin 12 can move upwards or downwards as described above. Turning the handle 13 in a first direction can lower the pin 12 to open the R-1234yf self-sealing valve and turning the handle 13 in an opposite, second direction will raise the pin 12 to close the R-1234yf self-sealing valve. Pin 12 preferably consists of rubber O-ring(s) 27 to prevent the refrigerant from leaking through the top throat 15. The preferred embodiment of pin 12 terminates in blunt depressor 18.

A gasket 16 is positioned in an annular configuration at the tap body inlet 17, and is located so as to be capable of contacting a can when the tap is affixed to a can (not shown). The gasket 16 may be used to minimize or prevent deformation of the can when the tap 20 is placed on the can. Also, the gasket 16 may provide a seal between the can and the tap 20. Gasket 16 is formed from a suitable deformable elastic material preventing the refrigerant from leaking while charging.

Figure 4:
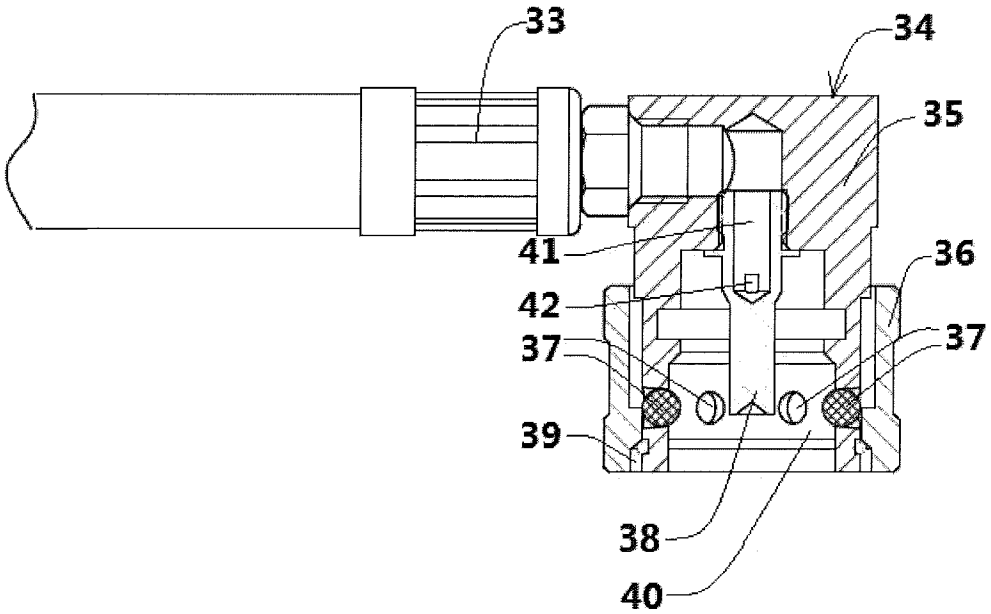
FIG. 4 demonstrates a longitudinal cross-section side view of a female portion of the R-1234yf charging hose assembly of FIG. 1 as seen along lines 29-29 in FIG. 5.
Figure 5:
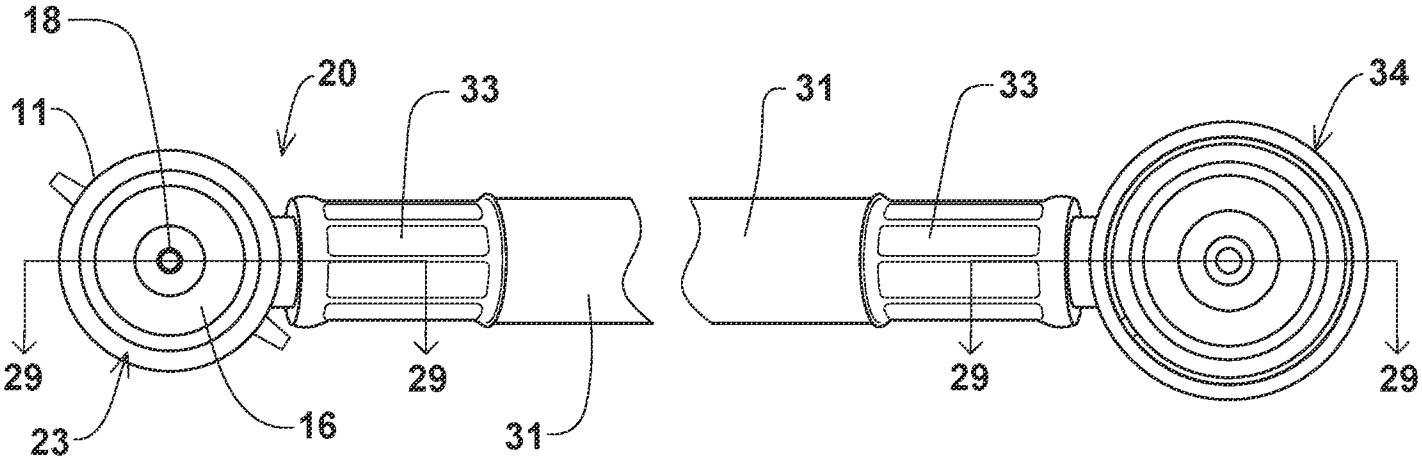
FIG. 5 illustrates planar bottom views of the male and female portions, respectively, of the R-1234yf charging hose assembly.
Figure 6:
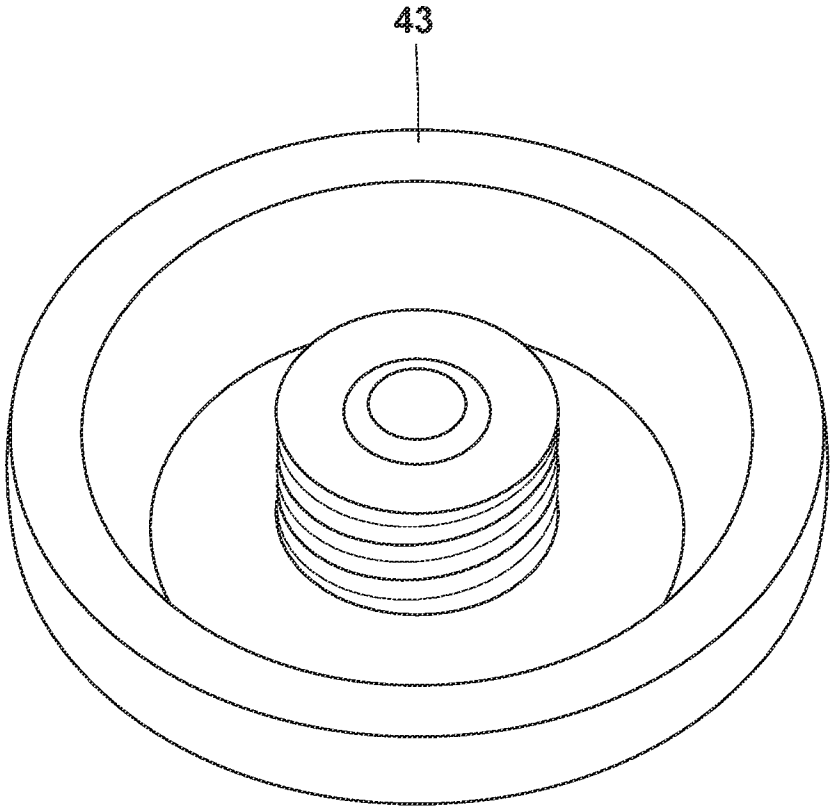
FIG. 6 features an elevated perspective view of a self-sealing valve for a R-1234yf can with one-half inch ACME left-handed thread.

FIGS. 1, 2 and 4 herein illustrate preferred coupler fitting 34 connectable to low side refrigerant circuit service fitting (not shown) for an R-1234yf automotive air conditioning system. The inlet is preferably attached to an end portion of the hose 31 by the tubular metal connector fitting 33. FIG. 5 is a bottom plan view of the can tap 20 and the coupler fitting 34. FIG. 6 herein is to illustrate the self-sealing valve 43 for R-1234yf with one-half inch ACME left-handed thread.

In a preferred embodiment, the coupler fitting 34 includes the main coupler body 35, collar 36, locking members 37, coupler pin 38 and interior flow passage 40. A circumferentially spaced series of locking balls 37 are the preferred coupler locking members carried in corresponding holes in a lower side wall portion of the main coupler body 35. An annular interior side surface recess 39 is formed in the collar 36 at its lower end. With the collar 36 in its locking position as demonstrated in FIG. 4, the recess 39 is disposed beneath the balls 37, and an interior side surface of the collar 36 above its interior side surface recess 39 holds the balls 37 in their locking positions. However, when the collar 36 is upwardly shifted to its release position, the reduced diameter interior side surface recess 39 is brought into vertical alignment with the balls 37 to permit them to be radially outwardly shifted to their release positions. Pin 38 has hollow portion 41. Openings 42 are located in pin 38 to allow fluid in hollow portion 41 to exit through flow passage 40. It should be noted that although the previously described structure is preferred, other embodiments of mechanical connectors, including a variety of shapes as well as mechanical members (threaded fasteners, spring-loaded fasteners, rotatable fasteners, releasable adhesives, hook and loop fasteners, or the like) are known in the art to perform the same function, and therefore are considered within the scope of the instant invention.

Figure 7:
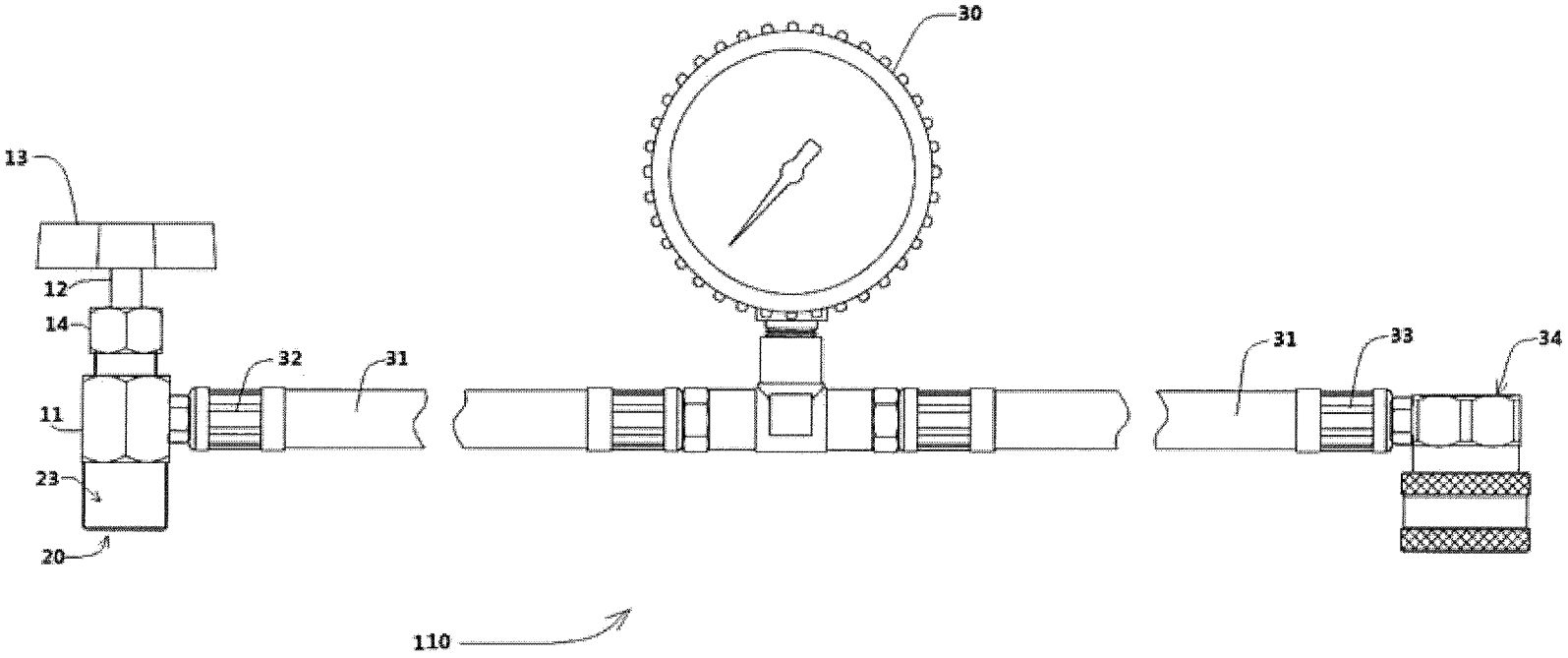
FIG. 7 shows a side view of an alternate embodiment of a R-1234yf charging hose assembly of indeterminate length.

FIG. 7 illustrates an alternate embodiment of refrigerant charging hose assembly 110 that serves as a refrigerant charging/pressure testing hose assembly which also embodies principles of the present invention and is useable to check the pressure of the refrigerant circuit flow and pressurized refrigerant R-1234yf, disposed within a pressurized refrigerant can equipped with the one-half inch ACME left-handed thread self-sealing valve, into an R-1234yf automotive air conditioning system via its low side refrigerant circuit service fitting. Similar numbers used herein are intended to relate to the similar structure as previously described. The refrigerant charging hose assembly 110 includes a length of R-1234yf charging hose 31 having tubular metal connector fittings 32 and 33 fixedly secured to its opposite ends. Fitting 32 may be permanently anchored to the R-1234yf self-sealing valve can tap 20 and fitting 33 may be permanently anchored to the coupler fitting 34 designed for the R-1234yf automotive air conditioning system. In one or more alternate embodiment(s), can tap 20, preferably defined as the R-1234yf self-sealing valve can tap 20, is removable from the charging hose 31, preferably defined as a R-1234yf charging hose, by the tubular metal connector fitting 32. In one or more alternate embodiments(s), coupler fitting 34 as designed for the R-1234yf air conditioning system (not shown) is removable from the R-1234yf charging hose 32 by the tubular metal connector fitting 33. Embodiments of said connector fittings 32, 33 may have releasably threaded members, releasably mechanical members, or releasably adhesive members to effectuate the removal of hose 31 from can tap 20 and/or fitting 34. A pressure gauge 30 is preferably connected in a longitudinally intermediate portion of the hose 31. Pressure gauge 30 is configured (i.e. sized, shaped, and otherwise designed) to receive fluidic pressure information from the refrigerant flowing within hose 31. In one embodiment, analog pressure gauge 30 mechanically determines the pressure of fluid flowing within hose 31. In another embodiment, pressure gauge 30 electronically or digitally determines the pressure of the fluid flowing within hose 31. In a further embodiment, pressure gauge 30 wirelessly receives pressure information from a sensor (not shown) that determines the pressure of the fluid flowing within hose 31. Regardless of the manner in which pressure gauge 30 receives and/or displays information pertaining to the pressure of fluid flowing within hose 31, all embodiments are concerned within the scope of the instant disclosure.

The illustrations and examples provided herein are for explanatory purposes and are not intended to limit the scope of the appended claims

I claim:

1. A refrigerant charging hose assembly operable to determine and display pressure information derived from fluid within a refrigerant circuit flowing from a pressurized refrigerant can of R-1234yf refrigerant equipped with a one-half inch ACME left-handed self-sealing valve into a R-1234yf automotive air conditioning system via a low side refrigerant circuit service fitting, the assembly comprising, a length of R-1234yf refrigerant charging hose defining first and second ends;

a can tap on the R-1234yf refrigerant charging hose first end connectable to the refrigerant can of R-1234yf refrigerant via the one-half inch ACME left-handed thread on the self-sealing valve, the can tap defined by:

a tap body defining a main body, a lower end further defining a threaded inlet with a one-half inch ACME left-handed thread, an upper end defining an outlet connected to the length of R-1234yf refrigerant charging hose, an internal thread, and a throat oriented between the lower end and the upper end, the throat in fluidic communication with the threaded inlet and the outlet and defining a lesser diameter than a diameter defined by the inlet;

a spherical backflow preventer positioned at, and disposed within, a connection between the outlet and the throat, the connection forming an opening defining a major axis perpendicular to a major axis defined by the throat, the backflow preventer configured to permit the refrigerant fluid flowing from the throat to the outlet by displacing along the major axis of the opening, and configured to stop the refrigerant fluid flow from the outlet to the can by defining a diameter greater than the connection opening and moving back along the major axis of the opening;

a pin positioned within the tap body including an upper nut secured to the tap body, the pin perpendicularly disposed relative to, and attached to a handle, the pin defining a greater diameter at an upper portion that is located more proximate the handle and a lesser diameter at an opposing, lower end and, a lower end defining a blunt depressor configured for contact with the R-1234yf refrigerant can, wherein the blunt depressor is configured to engage the self-sealing valve of the R-1234yf refrigerant can by rotating the handle in a first direction to lower the pin and open the self-sealing valve, and wherein the fluid flows between the tap body and the pin until the handle is rotated in a second direction, raising the pin and closing the self-sealing valve;

one or more O-rings on the tap body upper end to prevent the refrigerant fluid from leaking through a top throat; and a gasket comprising a resilient material that prevents the refrigerant from leaking while charging;

a pressure gauge installed in the hose between the can tap and a coupler fitting; and the coupler fitting on the R-1234yf refrigerant charging hose second end connectable to the low side refrigerant circuit service fitting of a R-1234yf automobile air conditioning system.

2. The refrigerant charging hose assembly of claim 1 wherein the pressure gauge is defined as an analog pressure gauge installed in the length of refrigerant charging hose between the can tap and the coupler fitting.

3. The refrigerant charging hose assembly of claim 1 wherein the pressure gauge is defined as a digital pressure gauge installed in the length of refrigerant charging hose between the can tap and the coupler fitting.

4. The refrigerant charging hose assembly of claim 1 wherein the pressure gauge is defined as a wireless pressure gauge installed in the length of refrigerant charging hose between the can tap and the coupler fitting.

5. A refrigerant charging hose assembly operable to determine and display pressure information derived from fluid within a refrigerant circuit flowing from a pressurized refrigerant can of R-1234yf refrigerant equipped with a one-half inch ACME left-handed self-sealing valve into a R-1234yf automotive air conditioning system via a low side refrigerant circuit service fitting, the assembly consisting of, a length of R-1234yf refrigerant charging hose defining first and second ends;

a can tap on the R-1234yf refrigerant charging hose first end connectable to the R-1234yf refrigerant can via a one-half inch ACME left-handed thread on the self-sealing valve, the can tap defined by:

a tap body defining a main body, a lower end further defining a threaded inlet with a one-half inch ACME left-handed thread, an upper end defining an outlet connected to the length of R-1234yf refrigerant charging hose, an internal thread, and a throat oriented between the lower end and the upper end, the throat in fluidic communication with the threaded inlet and the outlet and defining a lesser diameter than a diameter defined by the inlet;

a spherical backflow preventer positioned at, and disposed within, a connection between the outlet and the throat, the connection forming an opening defining a major axis perpendicular to a major axis defined by the throat, the backflow preventer configured to permit the refrigerant fluid flowing from the throat to the outlet by displacing along the major axis of the opening, and configured to stop the refrigerant fluid flow from the outlet to the can by defining a diameter greater than the connection opening and moving back along the major axis of the opening;

a cylindrical pin positioned within the tap body including an upper nut secured to the tap body, the pin perpendicularly disposed relative to, and attached to a handle, the pin defining a greater diameter at an upper portion that is located more proximate the handle and a lesser diameter at an opposing, lower end and, a lower end defining a blunt depressor configured for contact with the R-1234yf refrigerant can, wherein the blunt depressor is configured to engage the self-sealing valve of the R-1234yf refrigerant can by rotating the handle in a first direction to lower the pin and open the self-sealing valve, and wherein the fluid flows between the tap body and the pin until the handle is rotated in a second direction, raising the pin and closing the self-sealing valve;

one or more O-rings on the tap body upper end to prevent the refrigerant fluid from leaking through a top throat; and a gasket comprising a resilient material that prevents the refrigerant from leaking while charging;

a pressure gauge installed in the hose between the can tap and a coupler fitting; and the coupler fitting on the R-1234yf refrigerant charging hose second end connectable to the low side refrigerant circuit service fitting of an R-1234yf automobile air conditioning system.

6. The refrigerant charging hose assembly of claim 5 wherein the pressure gauge is defined as an analog pressure gauge installed in the length of refrigerant charging hose between the can tap and the coupler fitting.

7. The refrigerant charging hose assembly of claim 5 wherein the pressure gauge is defined as a digital pressure gauge installed in the length of refrigerant charging hose between the can tap and the coupler fitting.

8. The refrigerant charging hose assembly of claim 5 wherein the pressure gauge is defined as a wireless pressure gauge installed in the length of refrigerant charging hose between the can tap and the coupler fitting.

* * * * *